United States Patent [19]

Westenberger

[11] Patent Number: 5,038,733

[45] Date of Patent: Aug. 13, 1991

[54] LOAD ADJUSTMENT DEVICE

[75] Inventor: Helmut Westenberger, Hofheim/Ts., Fed. Rep. of Germany

[73] Assignee: VDO Adolf Schindling AG, Frankfurt am Main, Fed. Rep. of Germany

[21] Appl. No.: 568,553

[22] Filed: Aug. 16, 1990

[30] Foreign Application Priority Data

Aug. 16, 1989 [DE] Fed. Rep. of Germany ..... 3927043

[51] Int. Cl.[5] ..... F02D 9/10; F02D 41/08

[52] U.S. Cl. ..... 123/339; 123/399

[58] Field of Search ..... 123/339, 399, 400, 361, 123/403

[56] References Cited

U.S. PATENT DOCUMENTS

| | | | |
|---|---|---|---|
| 4,526,060 | 7/1985 | Watanake | 74/626 |
| 4,791,902 | 12/1988 | Ishikawa et al. | 123/399 |
| 4,809,656 | 3/1989 | Suzuki | 123/399 X |
| 4,829,959 | 5/1989 | Terazawa | 123/349 |
| 4,879,657 | 11/1989 | Tamura et al. | 123/399 X |
| 4,896,640 | 1/1990 | Pfalzgraf et al. | 123/399 |
| 4,903,936 | 2/1990 | Kajiwara | 123/399 X |
| 4,919,097 | 4/1990 | Mitui et al. | 123/399 |
| 4,953,529 | 9/1990 | Pfalzgraf et al. | 123/399 X |
| 4,961,355 | 10/1990 | Irino et al. | 123/399 X |

FOREIGN PATENT DOCUMENTS

| | | |
|---|---|---|
| 0208222 | 1/1987 | European Pat. Off. . |
| 3641244 | 6/1988 | Fed. Rep. of Germany . |
| 59-122742 | 7/1984 | Japan . |
| 2113298 | 8/1983 | United Kingdom . |

*Primary Examiner*—Willis R. Wolfe
*Attorney, Agent, or Firm*—Martin A. Farber

[57] ABSTRACT

A load adjustment device, by which the power of an internal combustion engine can be regulated, has a driver (4) which is coupled to an accelerator pedal (1) and cooperates via a regulating element with a setting member (9) which determines the output of the internal combustion engine. The setting member has a first regulating-element part (8*a*) and a second regulating-element part (8*b*) which can be disconnected from each other in order, in this way, to be able to control the setting member (9) independently of the driver (4) via an electric setting drive (14). Within the second regulating-element part (8*b*) there is contained, in accordance with the invention, a step-up device (torque converters 30*a*, 30*b*) for the setting-drive-side movement. An emergency operation spring (20) urges the second regulating-element part (8*b*) in the direction of maximum idle position into an emergency idle position, and produces, upon failure of the electric setting drive (14) or of a control device (17) which electronically controls the load adjustment device, a transfer of the setting member (9) into an emergency idle position. An auxiliary spring (31) which is pre-tensioned in the direction of minimum idle position over the entire idle control range, provides assurance that a friction/detent moment of the currentless electric setting drive can be overcome.

14 Claims, 2 Drawing Sheets

LOAD ADJUSTMENT DEVICE

FIELD AND BACKGROUND OF THE INVENTION

The present invention relates to a load adjustment device having a regulating element which can act on a setting member which determines the power of an internal combustion engine, and cooperates with a driver coupled with an accelerator pedal, and can be controlled, in addition, by an electric setting drive which cooperates with an electronic control unit.

On load adjustment devices, particularly load adjustment devices cooperating with carburetors or injection pumps, optimum control of an internal combustion engine over the entire load range is necessary. For this, a complicated construction or a complicated regulation of the corresponding load adjustment device has been necessary. Thus carburetors, for instance, in addition to the actual means for forming the mixture, have additional devices such as leaning, starting, idling, accelerating and economizing devices, etc. These devices complicate the construction of the carburetor and result in increased expense for structural parts, in particular, for instance, additional injection nozzles, pumps, special developments of the nozzle needles and separate air feeds, entirely aside from the high requirement as to regulation connected therewith.

In load adjustment devices there is of particular importance a control of the state of load upon idling, where only minimum power is given off by the internal combustion engines. This however, under certain circumstances and specifically in motor vehicles, is in contradistinction to load consuming devices which require a large amount of power, such as blowers, rear window heater, air conditioners, etc. In order to take these possible power requirements into account, control of the load adjustment device between a maximum idle position and a minimum idle position is necessary. Upon failure of the control, an emergency idle position of the setting member or regulating element is to be assured.

In contradistinction to the problems described above, load adjustment devices of the type are used, as a general rule, in cases in which the accelerator pedal and the setting member are electronically connected with each other. The accelerator pedal is coupled to the driver and the latter is coupled to a regulating element. Furthermore, a desired-value detection element associated with the driver is provided, as well as an actual-value detection element which cooperates with it and acts on an electric setting driver. The electric setting driver is adapted to be controlled by an electronic control device as a function of the values detected.

The electric connection of accelerator pedal and setting member to the interposed electronic control device makes it possible to set desired-value positions predetermined by the accelerator pedal and the driver coupled to it, with reference to the actual-values established by the position of the regulating element and the setting member. The connection makes it possible to check the pedal and the driver for the existence or absence of plausibility conditions. Thereby, when given plausibility conditions are present or absent there is the possibility, via the electronic control device, to act on the setting member, which can be developed, for instance, as throttle valve or injection pump, in corrective fashion by controlling the electric setting drive. Thus, for instance, intervention by the electronic control device can be provided in order to avoid wheel slippage upon starting, due to a giving of too much power by the gas pedal. Other automatic interventions into the load adjustment device are, for instance, conceivable in the case of automatic shifting of a transmission or a speed governor control or in the case of the previously discussed idle control of the internal combustion engine.

SUMMARY OF THE INVENTION

It is an object of the invention to create a load adjustment device of the aforementioned type which, while being of structurally simple development, permits a dependable and precise control of the internal combustion engine over the entire idle range.

According to the invention, the setting path of the driver (4) in idle direction is limited by an idle stop (LL) and, when the driver (4) rests against the idle stop (LL), the regulating element (8*a*, 8*b*) can be moved within its idle control range relative to the driver (4) by means of the setting drive (14). The regulating element (8*a*, 8*b*) has a first regulating-element part (8*a*) which cooperates with the driver (4) and on which an idle spring (12*a*) which is pre-tensioned in the direction of minimum idle position over the entire idle control range acts, as well as a second regulating-element part (8*b*) which is controllable by means of the setting drive (14). An emergency travel spring (20) is disposed on the second regulating-element part (8*b*) and is pre-tensioned in the direction of maximum idle position into an emergency idle position. An auxiliary spring (31) also is disposed on the second regulating-element part (8*b*) and pre-tensions this regulating-element part (8*b*) in the direction of minimum idle position over the entire idle control range. The first regulating-element part (8*a*) extends, on the side of the second regulating element (8*b*) associated with the maximum idle position, into the setting path of said second regulating-element part (8*b*), and a step-up of the setting-drive-side movement taking place within the second regulating-element part (8*b*).

As a result of the development of the load adjustment device in accordance with the invention, a control is effected within the entire idle control range exclusively by means of a single setting member so that no additional means are required for forming the mixture in the idle control range. The regulating element which moves the setting member is moveable in the idle control range by means of the electric setting drive independently of the driver, while outside the idle control range it is coupled to the driver, and the latter can move the regulating element and thus the setting member.

Of particular importance in this connection is the development of the regulating element with the two regulating-element parts. The first regulating-element part cooperates directly with the setting member and represents, on the one hand, the connection to the driver and, on the other hand, via the second regulating-element part, the connection to the electric setting drive. The idle spring serves to return the first regulating-element part and, in an increased idle position of the second regulating-element part, due to the superposing of the setting path of the two regulating-element parts, also serves to return the second regulating-element part. The emergency travel spring cooperates in the opposite direction of action exclusively with the second regulating-element part.

By the division of the regulating element into the first and the second regulating-element parts, assurance is had that the movement of the driver in partial-load/full-load operation of the internal combustion engine can take place independently of the elements associated with the electric setting drive, and this exclusively against the direction of action of a single spring, namely, the idle spring.

In accordance with a special feature of an embodiment of the invention, it is finally provided that an auxiliary spring urges the second regulating-element part in the direction towards minimum idle position over the entire idle control range, and that stepping up of the setting-drive-side movement takes place within the second regulating-element part. In particular when the setting element is developed as throttle valve it is merely necessary, in order to control the idling of the internal combustion engine, to swing the throttle valve within a small angular swing, which as a general rule is less than 10°. Such small ranges of swing can, however, not be obtained, or obtained only at great control expense, by means of electric setting drives, particularly if the drivers are to be developed as electric motors of comparatively small size.

By the invention it is possible to use electric setting drives of small output torque, the output movement of which extends over a relatively large range of swing or rotation, and is converted into movement of the throttle valve within the said small range of swing. The auxiliary spring, in this connection, supports the return of the throttle valve. The force of return should be so dimensioned that, upon a failure of the electronic control device or of the electric setting drive, the second regulating-element part moves, in opposition to a friction/detent moment of the setting drive, into the emergency idle position.

The spring force of the emergency travel spring is to be so dimensioned that it can overcome not only the force of the idle spring but, in addition, also the forces of the auxiliary spring and other forces acting in the system. For example, the other forces may be caused, in case of the development of the setting member as a throttle valve which is eccentrically supported for safety reasons, by the vacuum forces in the intake tube acting in closing direction on said valve. In connection with the arrangement of the auxiliary spring, it is advantageous that it be associated with the second regulating-element part and that the two regulating-element parts be uncoupled from each other in the partial-load/full-load region. Thereby, in these operating conditions, the first regulating-element part need not be moved in addition against the force of the auxiliary spring by the driver.

In accordance with one particular embodiment of the invention, it is provided that to the setting drive (14) there is connected a step-up (in torque) transmission (30*a*, 30*b*) having a setting-drive-side transmission drive shaft (81*b*), a transmission intermediate shaft (82*b*) and a setting-member-side transmission driven shaft (83*b*).

According to a feature of the invention, the transmission of force between the transmission shafts (81*b*, 82*b*, 83*b*) is effected by means of gear wheels (84*b*, 85; 86*b*, 87*b*).

With such a development with a transmission intermediate shaft, the step-up ratios from transmission drive shaft to transmission intermediate shaft and transmission intermediate shaft to transmission driven shaft would be approximately the same. The step-up ratio (i) (in torque) from the setting drive to the setting member should advantageously amount to 50 to 200, and in particular, 70 to 100. The step-up within a step-up drive with transmission intermediate shaft is advantageous for considerations of space. In principle, the movement between the electric setting drive and the setting member can be stepped up in any desired manner.

The emergency operation spring (20) is advantageously arranged in the region of the transmission driven shaft (83*b*).

According to another feature of the invention, the auxiliary spring (31) is arranged in the region of the transmission drive shaft (81*b*).

According to a further feature of the invention, the emergency operation (20) and the auxiliary spring (31) are developed as coil springs which surround the transmission driven shaft (83*b*) and the transmission drive shaft (81*b*), respectively.

In addition to this, the emergency operation spring (20) is urged toward an emergency position stop (22) or else has a free run in the region from the idle emergency position up to the maximum idle position.

As a result of the stepping up of the movement of the electric setting drive, it is considered advantageous if a structural part (18) which determines the position of the second regulating-element part (8*b*), in particular the actual-value detection element, acts on the transmission intermediate shaft (82*b*) or the transmission drive shaft (83*b*) and thus on a place where the position of the setting member can be detected more precisely due to the stepping up.

According to a feature of the invention, the setting member (9) is developed as throttle valve.

DETAILED DESCRIPTION OF THE PREFERRED EMBODIMENT

Figure 1:
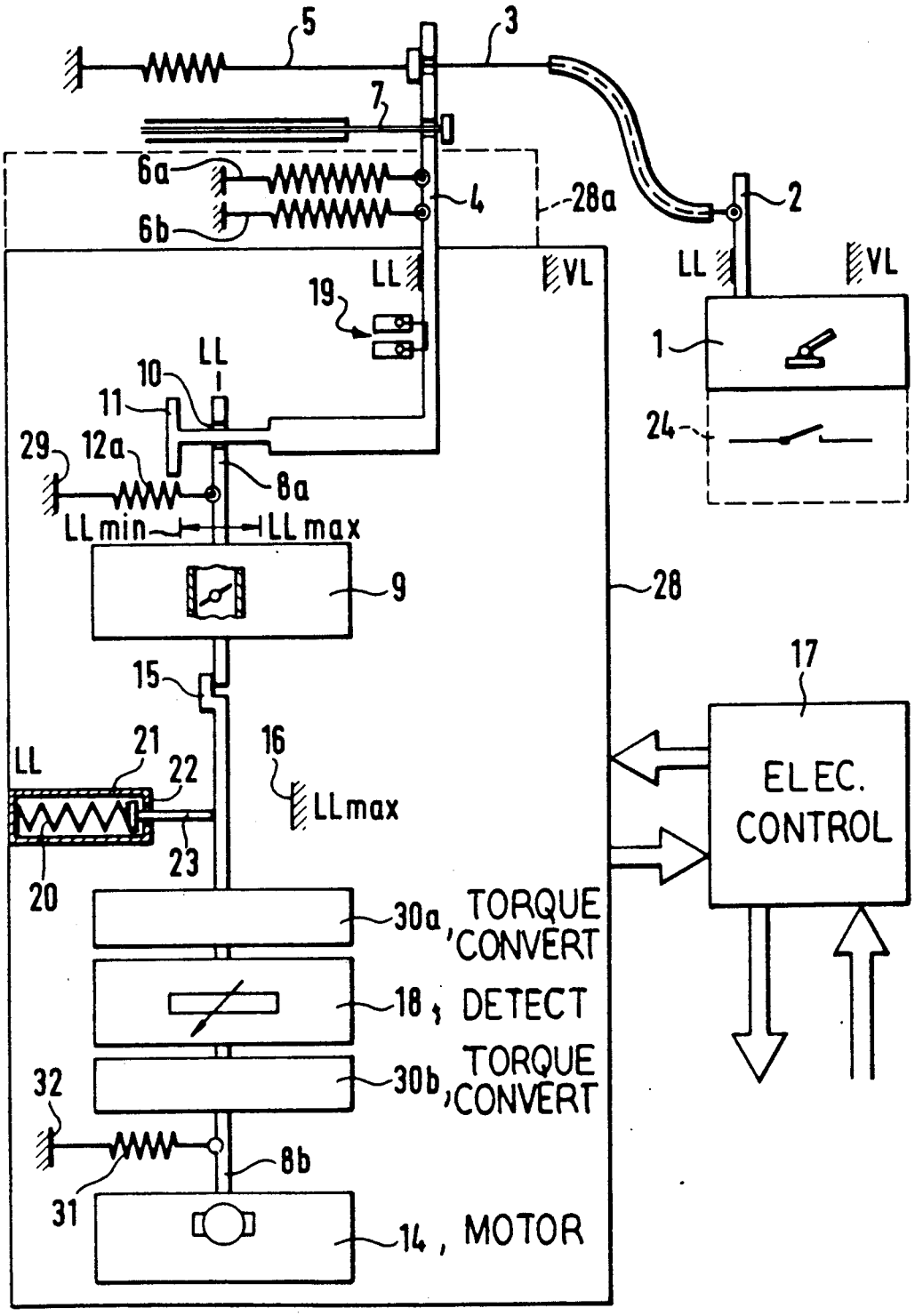
FIG. 1 is a block diagram of the load displacement device of the invention in the idle control function, shown in the emergency travel position.

FIG. 1 shows an accelerator pedal 1, by which a lever 2 can be displaced between an idle stop LL and a full-load stop VL. Via a gas cable 3 the lever 2 can displace a driver 4, moveable between a further idle stop LL and a furthe full-load stop VL, in the direction of the full-load stop VL. The lever 2 is urged in idle direction by means of a return spring 5 acting on the gas pull 3. Two return springs 6*a* and 6*b* which act on the driver 4 urge it in idle direction, the two springs 6*a* and 6*b* being so designed that they have redundant effects on the reset drive. Each one of the return springs 6*a* and 6*b* is capable of applying the forces in order to transfer the driver 4, even with due consideration of the system-inherent opposing forces acting on it, into its idle position. When the gas pull 3 is not acted on, the driver 4 thus lies against the idle stop LL associated with it. The driver 4 can also displace an automatic pull 7 of an automatic transmission not shown in detail.

The driver 4 cooperates directly with a first regulating-element part 8*a* which serves to displace a setting member, which is developed as throttle valve 9, of the internal combustion engine. In detail, the end of the first regulating-element part 8*a* facing the driver 4 is provided with a recess 10 behind which an extension 11 of the driver 4 engages. Between the regulating-element part 8a and a fixed point 29 there is arranged an idle spring 12a which acts on the regulating element 8a in idle direction over the entire idle control range ($LL_{min}$ to $LL_{max}$). With a minimum idle position of the first regulating-element part 8a, the latter lies against the extension 11 of the driver 4. Furthermore, upon a movement of the driver 4 via the accelerator pedal 1 outside of the idle control range, i.e. in the partial-load/full-load operation, the first regulating-element part, which acts on the setting member 9, is displaced corresponding to the movement of the driver 4.

The load adjustment device of the invention has, in addition to the first regulating-element part 8a, a second regulating-element part 8b which is connected to an electric motor 14. Within the second regulating element 8b, step-up of the setting-motor-side movement takes place by means of torque converters 30a and 30b, the construction of which will still be described. Between the torque converter 30b and the electric motor 14, one end of an auxiliary spring 31 acts on the second regulating-element part 8b, the other end of the spring 31 being connected to another stationary point 32. The auxiliary spring 31 urges the second regulating-element part 8b in the direction of minimum idle position over the entire idle control range.

In order to be able to couple the two regulating-element parts 8a and 8b mechanically with each other, the second regulating-element part 8b has an extension 15. The first regulating element 8a extends on the side of the extension 15 facing the maximum idle position into the setting path thereof and thus the setting path of the second regulating element 8b. A movement of the second regulating-element part 8b in $LL_{max}$ or full-load direction or $LL_{min}$ direction thus leads to a resting of the extension 15 against the first regulating-element part 8a. Then, by means of the electric motor 14, the first regulating-element part 8a can be displaced in the direction of maximum idle position against the force of the spring 12a and against the force of an emergency operation spring 20, via a ram 23, to contact a stop 22 in the $LL_{min}$ position.

As shown in FIG. 1, the displacement path of the second regulating-element part 8b and thus, also the displacement path of the first regulating-element part 8a in the direction of maximum idle position, is limited by a stop 16 which extends into the path of the second regulating-element part 8b in the position of maximum idle $LL_{max}$. A limiting of the second regulating-element part 8b in the position of minimum idle position is not necessary since either the first regulating-element part 8a rests in this position against the extension 11 of the driver 4 or the second regulating-element part 8b comes against a stationary sleeve 21.

The control of the load adjustment device of the invention is effected by means of an electronic control device 17. The control device 17 cooperates an actual-value detection device 18 for the idle range which determines the position at the present time of the first regulating-element part 8a and is arranged between the two torque converters 30a and 30b. In addition, the electronic control device 17 detects signals which come from an idle contact 19 which is activated whenever the driver 4 rests against the idle stop LL associated with it. Furthermore, external variables of state with regard to the internal combustion engine or, in general concerning an automotive vehicle equipped with the engine are introduced into the control device 17, and called up by the latter and transferred by the control device 17 to the electric motor 14 acting on the second regulating-element part 8b.

The electronic control device 17 thus serves, in cooperation with the actual-value detection device 18 and the idle contact 19 as well as the external reference variables, for the purpose of building up a safety logic with regard to the regulating of the first and second regulating-element parts 8a and 8b as well as driver 4. If the lever 2 which cooperates with the accelerator pedal 1 is in its idle position LL and the driver 4 is thus also against the idle stop LL, the contacting of the idle contact 19 takes place. When plausibility conditions are present, the electric motor 14 is activated via the electronic control device 17, and the setting member 9, as desired by the control device 17, is controlled in the idle range between the minimum and a maximum idle position.

Plausibility conditions are verified in this connection inter alia by means of the actual-value detection device 18, with which the entire idle control region of the internal combustion engine can be represented. Should the electronic control device 17 or the electric motor 14 be without voltage, the path-limited emergency operation spring 20, which directs its force in the direction of the maximum idle position, effects the transfer of the second regulating element part 8b into the idle emergency position $LL_{Not}$. In order to be able to effect this, the force of the emergency operation spring 20 must be so great that it not only overcomes the force of the idle spring 12a but, in addition, also that of the auxiliary spring 31 and the vacuum forces in the intake pipe acting on the throttle valve 9 in the closing direction. Since ordinarily the throttle valve 9 is mounted eccentrically so that a vacuum acts on the throttle valve 9 at all times in the closing direction, upon movement of the second regulating-element part 8b by means of the electric motor 14 in the direction of the minimum idle position, a tensioning of the emergency operation spring 20 conversely takes place.

In the event that after the release of the accelerator pedal 1 the driver 4 should not be displaced in the idle direction, a contact switch 24 is provided on the accelerator pedal 1, by which switch such an erroneous condition can be detected.

By the frame 28 in FIG. 1 it is indicated that the parts surrounded by it form one structural unit. A further dashed-line frame 28a is intended to indicate that also the reset drive of the driver 4, represented by the springs 6a and 6b, can be part of the structural unit.

Figure 2:
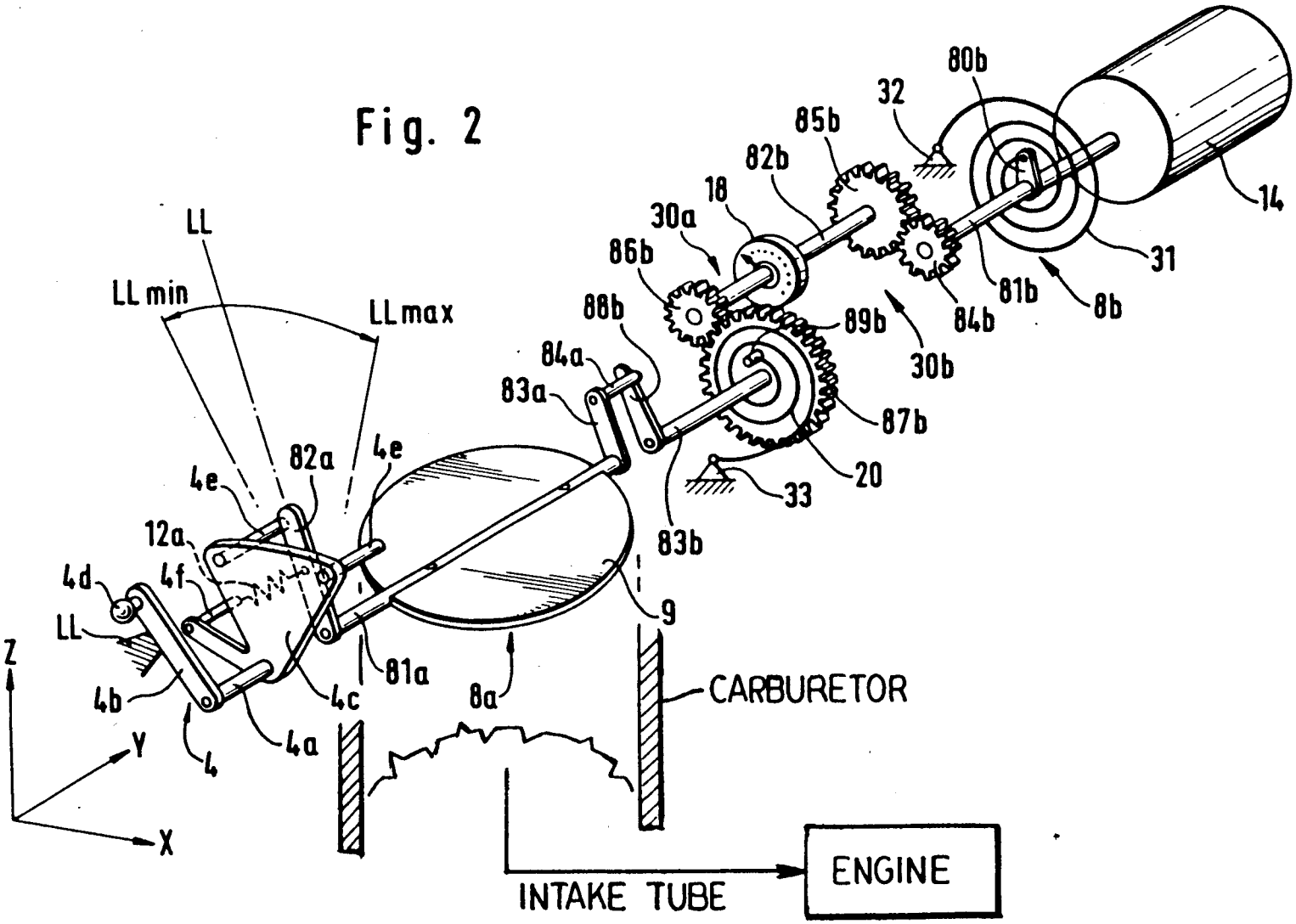
FIG. 2 shows the basic construction of such a load displacement device with a setting member in the form of a throttle value, a portion of the carburetor connection to an engine being shown diagrammatically.

FIG. 2 shows the interaction of driver 4 and the two regulating-element parts 8a and 8b and furthermore the basic construction of the torque converters 30a and 30b, as well as the arrangement of the springs 12a, 20 and 31 acting on the two regulating-element parts 8a and 8b. The figure shows, first of all, the driver 4, which consists essentially of a mounting shaft 4a which is swingable around the Y-coordinate, of a lever 4b which is rigidly connected to it as well as a plate 4c which is spaced from it and also firmly connected to a bearing shaft 4a. In the position shown in FIG. 2, the lever 4b of the driver 4 rests against the idle stop LL. The end of the lever 4b facing away from the bearing shaft 4a is provided with a ball pin 4d for connection with the gas cable 3 which is not further shown.

The plate 4c has substantially the shape of a triangle. In the corners of the plate 4c remote from the bearing shaft 4a, two bolts 4e which extend in Y direction are connected to the plate, which bolts, corresponding to the arrangement of the extension 11 and the adjacent thickening of the driver 4 shown in FIG. 1, form a free path for the first regulating-element part 8*a*. The latter has a bearing shaft 81*a* which extends in the direction of the Y-coordinate and which receives, fixed for rotation, the setting member 9 developed as throttle valve. The end of the bearing shaft 81*a* facing the driver 4 is connected, fixed for rotation, with the lever 82*a*. The lever 82 extends into the space between the two bolts 4*e* and is thus limited in its relative swinging motion with respect to the driver 4. The lever 82*a* urges the idle spring 12*a* in the idle direction of the setting member 9, the spring 12*a*, in contradistinction to the showing of FIG. 1, acting in the basic diagram of FIG. 2 on a bearing pin 4*f* of the driver 4 which is remote from the bearing shaft. In principle, the idle spring 12*a* can be fastened also on a fixed point instead of on the bearing pin 4*f*. Finally, the end of the bearing shaft 81*a* facing away from the lever 82*a* is connected to a lever 83*a* which, in its turn, has a bolt 84*a* which extends beyond the end of the bearing shaft 81*a* in the direction of the Y-coordinate.

The second regulating-element part 8*b* with the torque converters 30*a* and 30*b* integrated in it is formed essentially by the motor shaft of the electric motor 14 wherein the motor shaft serves as transmission drive shaft 81*b*. The transmission intermediate shaft 82*b*, as well as the throttle-valve-side transmission driven shaft 83*b*, are arranged in each case in the direction of the Y-coordinate. Furthermore, a pinion 84*b* is connected to the transmission drive shaft 81*b* and cooperates with a wheel 85*b* which is connected to the transmission intermediate shaft 85*b*. A pinion 86*b* which is furthermore connected to the shaft 85*b* cooperates with a wheel 87*b* which is connected to the transmission driven shaft 83*b*. Finally, the end of the transmission driven shaft 83*b* facing the throttle valve 9 has a lever 88*b* which extends on that side of the bolt 84*a* associated with the minimum idle position, into the setting member thereof.

The transmission driven shaft 83*b* is surrounded by the emergency operation spring 20, which is developed as coil spring. The inner end of this spring engages or acts on a bolt 89*b* which is connected, spaced from the transmission driven shaft 83*b*, to the wheel 87*b*. The outer end of the emergency operation spring 20 is connected to a fixed point 33. The emergency operation spring 20 urges the transmission driven shaft 83*b*, and thus the second regulating-element part 8*b* as a whole, in the direction of maximum idle position into the emergency idle position. In the emergency idle position, the coil spring is either relaxed or a separate stop is provided with which the bolt 89*b* comes into engagement when the spring has only a slight initial tension.

The transmission drive shaft 81*b* is surrounded by the auxiliary spring 31, which is also developed as a coil spring and the inner end of which acts on a lever 80*b* connected fixed for rotation with the transmission drive shaft 81*b*, while its other end acts on the fixed point 32. The auxiliary spring 31 urges the transmission drive shaft 81*b*, and thus the second regulating-element part 8*b* as a whole, in the direction of minimum idle position over the entire idle control range.

Upon the operation by electric motor 14 of the setting member 9, the movements of the electric motor 14 are stepped up approximately equally via the two torque converters, 30*a* and 30*b*. It is provided that each of the two torque converters has a step-up ratio of 10, whereby there results an overall step-up ratio of 100. If one assumes that the throttle valve 9 is to be displaced by electric motor between the operating positions $LL_{min}$ and $LL_{max}$ within an angular range of 8°, this means that the motor shaft, and thus the transmission drive shaft 81*b*, is to be swung by 800°. In particular, the auxiliary spring 31 makes certain in this connection that in the event of a defect in the electronic control device 17 or the electric motor 14, the friction/detent moment of the currentless electric motor 14 is overcome in every position so that the return of the throttle valve 9, with assistance of the idle spring 12*a*, is assured. Upon the stepping-up of the rotary movement of the motor shaft, the actual-value detection device 18 is advantageously arranged in the region of the transmission intermediate shaft 82*b*, whereby a substantially improved power of resolution of the actual-value detection device 18 is obtained.

I claim:

1. A load adjustment device comprising a regulating element and a setting member, the regulating element acting on the setting member to determine the power of an internal combustion engine;

an accelerator pedal, and a driver coupled with the accelerator pedal and cooperating with the regulating element;

an electronic control means, and an electric setting drive which cooperates with the electronic control means and the regulating element for controlling the engine;

an idle stop, an idle spring, an emergency operation spring, and an auxiliary spring; and wherein said regulating element comprises a first regulating-element part and a second regulating-element part;

a setting path of said driver in idle direction is limited by said idle stop;

upon a resting of said driver against said idle stop, said regulating element has an idle control range and is movable within its idle control range relative to said driver by means of said setting drive;

said first regulating-element part cooperates with said driver for transmission of mechanical motion from said driver to said setting member;

said idle spring is pre-tensioned in the direction of minimum idle position over the entire idle control range and acts upon said first regulating-element part;

said second regulating-element part is controllable by means of said setting drive;

said emergency operation spring is pre-tensioned in the direction of maximum idle position to urge said second regulating-element part into an emergency idle position;

said auxiliary spring pre-tensions said second regulating-element part in the direction of minimum idle position over the entire idle control range; and said first regulating-element part extends, on the side of said second regulating element closest the maximum idle position, into a setting path of said second regulating-element part, there being a step-up of torque of said setting drive within said second regulating-element part.

2. A load adjustment device according to claim 1, further comprising an emergency position stop operatively coupled to said second regulating-element part; and said emergency operation spring is urged by said setting drive toward said emergency position stop or else has a free run in the region from idle emergency position up to a maximum idle position.

3. A load adjustment device according to claim 1, further comprising a step-up torque transmission coupled to said setting drive to provide said torque step-up, said transmission including a transmission drive shaft coupled to said setting drive, a transmission intermediate shaft and a transmission driven shaft coupled to said setting member, the transmission intermediate shaft interconnecting the transmission drive shaft with the transmission driven shaft.

4. A load adjustment device according to claim 3, wherein said transmission comprises gear wheels for transmission of force between the transmission shafts.

5. A load adjustment device according to claim 4, wherein individual ones of said gear wheels are connected in said transmission to said drive shaft and said intermediate shaft to provide a first gear ratio between said drive and said intermediate shafts;

individual ones of said gear wheels are connected in said transmission to said intermediate and said driven shafts to provide a second gear ratio between said intermediate and said driven shafts; and said first and said second gear ratios together provide a step-up ratio from the setting drive to the setting member in the range of 50 to 200.

6. A load adjustment device according to claim 4, wherein individual ones of said gear wheels are connected in said transmission to said drive shaft and said intermediate shaft to provide a first gear ratio between said drive and said intermediate shafts;

individual ones of said gear wheels are connected in said transmission to said intermediate and said driven shafts to provide a second gear ratio between said intermediate and said driven shafts; and said first and said second gear ratios together provide a step-up ratio from the setting drive to the setting member in the range of 70 to 100.

7. A load adjustment device according to claim 5, wherein said first gear ratio from transmission drive shaft to transmission intermediate shaft and said second gear ratio from transmission intermediate shaft to transmission driven shaft are approximately the same.

8. A load adjustment device according to claim 3, wherein said emergency operation spring is disposed at said transmission driven shaft; and said auxiliary spring is disposed at said transmission drive shaft.

9. A load adjustment device according to claim 8, wherein said emergency operation spring and said auxiliary spring are developed as coil springs which surround the transmission driven shaft and the transmission drive shaft, respectively.

10. A load adjustment device according to claim 3, wherein said auxiliary spring is disposed at said transmission drive shaft.

11. A load adjustment device according to claim 10, wherein said emergency operation spring and said auxiliary spring are developed as coil springs which surround the transmission driven shaft and the transmission drive shaft, respectively.

12. A load adjustment device according to claim 3, further comprising a structural part which determines a position of the second regulating-element part, said structural part acting on said transmission intermediate shaft or the transmission drive shaft to accomplish a detection of the position of the setting member more precisely due to the torque step-up.

13. A load adjustment device according to claim 12, wherein said structural part is a detector of the actual value of said setting member.

14. A load adjustment device according to claim 12, wherein the setting member is developed as throttle valve.

* * * * *